US005343130A

United States Patent [19]

Paschedag et al.

[11] Patent Number: 5,343,130

[45] Date of Patent: Aug. 30, 1994

[54] CONTROL SYSTEM FOR AUTOMATICALLY HALTING THE MOVEMENT OF A MACHINE IN THE MINE WORKING

[75] Inventors: Ulrich Paschedag, Werne; Gerhard Merten, Lunen, both of Fed. Rep. of Germany

[73] Assignee: Westfalia Becorit Industrietechnik GmbH, Lunen, Fed. Rep. of Germany

[21] Appl. No.: 52,105

[22] Filed: Apr. 22, 1993

[30] Foreign Application Priority Data

May 2, 1992 [DE] Fed. Rep. of Germany ..... 4214688

[51] Int. Cl.[5] ..... F16D 7/02

[52] U.S. Cl. ..... 318/434; 241/36; 192/56 R

[58] Field of Search ..... 310/23; 241/36; 172/12; 192/150, 56 F, 56 R, 4 R; 361/23; 318/434

[56] References Cited

U.S. PATENT DOCUMENTS

| | | | |
|---|---|---|---|
| 3,245,285 | 4/1966 | Van Den Kieboom | 192/150 |
| 3,828,900 | 8/1974 | Anderson | 192/4 R |
| 4,031,964 | 6/1977 | Takahashi et al. | 172/12 |
| 4,245,526 | 1/1981 | Fruin et al. | 192/150 |
| 4,609,155 | 9/1986 | Garnier | 241/36 |
| 4,667,790 | 5/1987 | Bohle | 192/56 F |
| 4,910,419 | 3/1990 | Hayashi et al. | 310/23 |

FOREIGN PATENT DOCUMENTS

3017756A1 11/1981 Fed. Rep. of Germany .
3720208A1 12/1988 Fed. Rep. of Germany .

OTHER PUBLICATIONS

Sieker, Heinz Ulrich, "Betriebserfahrungen mit dem Überlastschutz-Getriebe S 20-ÜL auf dem Bergwerk Haus Aden", *Gluckauf* 126 (1990), pp. 621-627.
Rätz, Walter, "Neue Möglichkeitender Förderer-und Hobelsteuerung", *Bergbau*, Apr. 1976, pp. 111-114.

*Primary Examiner*—William M. Shoop, Jr.
*Assistant Examiner*—John W. Cabeca
*Attorney, Agent, or Firm*—Samuels, Gauthier & Stevens

[57] ABSTRACT

A machine, such as a plough, is driven with a chain back and forth along a guide to strip mineral from a mineral face. The chain is entrained around chain wheels at ends of the guide and the chain wheels are driven by electric motors and gearing assemblies. Each gearing assembly employs an overload protection which generates a signal in the event of an overload. A control unit with a computer responds to the overload signal to provide a stop signal to actuate a clutch to disconnected the drive. Stops are provided at the ends of the guide and spaced from each stop there is a sensor which provides a signal indicative of the presence of the machine. The control unit responds to the detection signal and provides the stop signal at an optimum time calculated by the computer to ensure the machine is halted at or near each end stop.

10 Claims, 1 Drawing Sheet

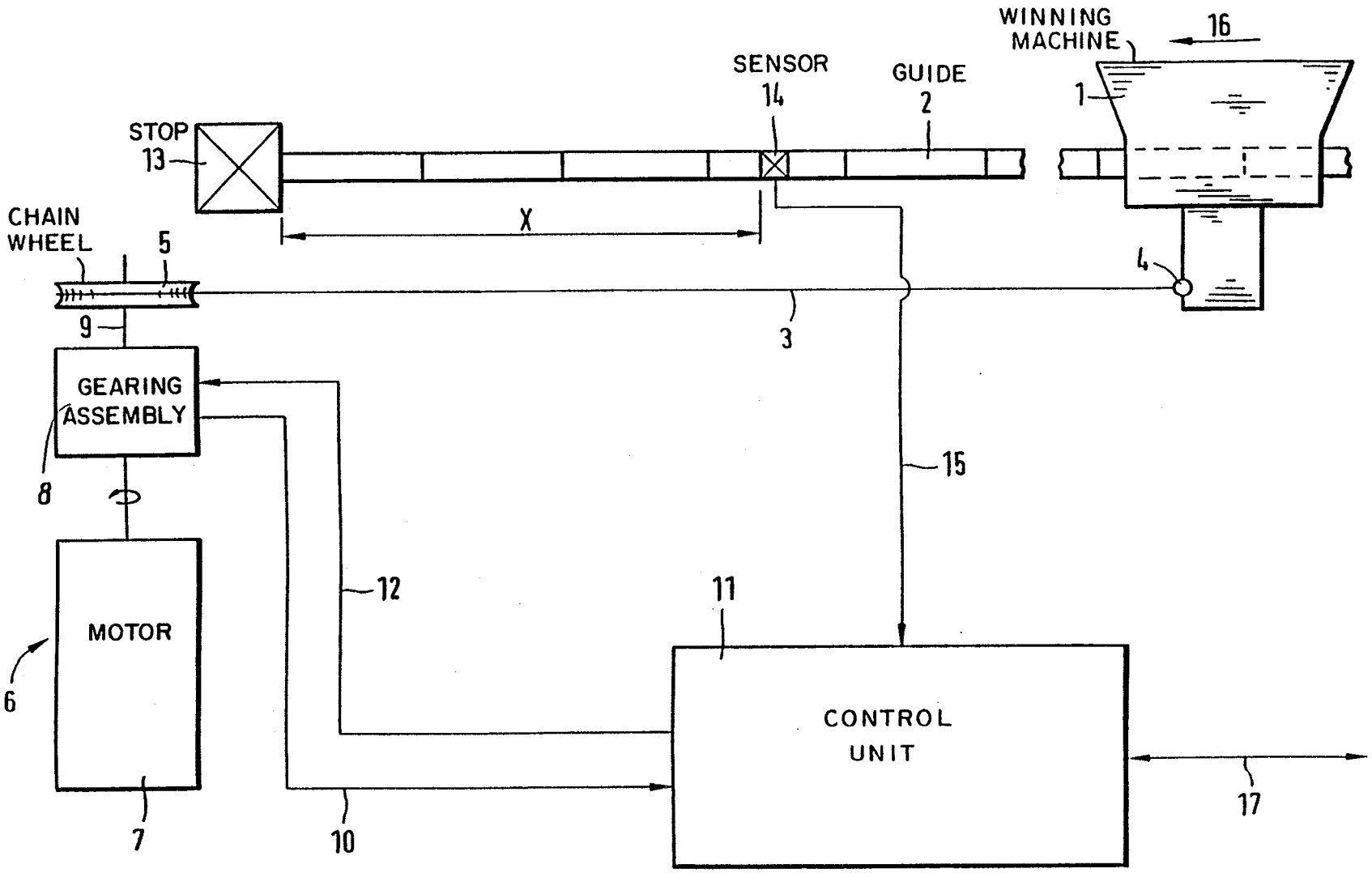
WINNING MACHINE
16
1
4
GUIDE
2
SENSOR
14
3
15
CONTROL UNIT
11
17
X
12
10
STOP
13
5
CHAIN WHEEL
9
GEARING ASSEMBLY
8
MOTOR
7
6

CONTROL SYSTEM FOR AUTOMATICALLY HALTING THE MOVEMENT OF A MACHINE IN THE MINE WORKING

FIELD OF THE INVENTION

The present invention relates in general to chain-driven mineral winning machines, such as ploughs, which are hauled back and forth along a guide, alongside a mineral face to strip mineral therefrom. More particularly, the invention relates to an automatic control system which serves to halt the movement of the machine at the ends of the guide.

BACKGROUND OF THE INVENTION

It is customary to provide mechanical stops at the ends of the guide which is normally disposed at one side of a scraper-chain conveyor disposed along the working and alongside the mineral face. It is also known from DE-3017756 to arrange limit switches near the ends of the guide which are actuated by the passage of the machine and cause one or both drive assemblies at the ends of the working to slow the machine to a creeping speed as it approaches one of the end stops. Once the machine has passed one of the limit switches its subsequent passage depends on a number of factors primarily the speed of the machine when it reaches the limit switch and the consequential inertia of the machine, the frictional forces in the drive to the chain and acting on the chain as well as the frictional forces between the guide and the machine and between the cutting implements of the machine and the mineral face and the extent to which any accumulations of material impede the movement of the machine.

A control system is known from "Bergbau" April 1976 page 111–114 in which a transmitter is provided on the body of a plough which provides signals detected by receivers disposed at set locations along the path of movement of the plough. The received signals are then used to effect halting of the movement of the plough at the ends of its path of movement.

If a machine or plough is traveling at high speed towards one of the end stops there are considerable forces and stress placed on the drive and the chain when the machine is slowed down and this can cause permanent deformation of the chain. In modern high performance mineral mining installations it is common to use an overload protection means which disengages the drive to the haulage chain usually through a clutch in the event of abnormally high forces. When the machine is being slowed down the clutch is apt to slip and this produces high wear. These problems are frequently aggravated when the machine is operating over regions of the mineral face which are difficult to mine effectively. Examples of an overload protection means which utilizes a rapidly responding electromagnetic valve to actuate the clutch in the event of an overload condition are described in "Glückauf" 1990, page 621–627. U.S. Pat. No. 4,667,790 and DE-3 720 208 the contents of which are herein incorporated by reference.

Hitherto it has not proved possible to control the movement of a machine or plough efficiently at the end regions of its path of movement.

A general object of the present invention is to provide an improved control system which can control the showing and halting of a machine or plough in a reliable and optimal fashion even when the machine is moving at high speed and which ensures there are no harmful effects due to the high forces which have to be dissipated.

SUMMARY OF THE INVENTION

According to the invention there is provided a control system for automatically halting the movement of a chain-driven mining machine moved back and forth along a path defined between end limits alongside a mineral face; said system comprising at least one drive means for driving the chain and the machine along said path, overload protection means with a mechanism for automatically disconnecting the drive in the event of an overload, a control unit which receives an electrical signal indicative of an overload and provides an electrical stop signal to actuate the mechanism and disconnect the drive and a sensor spaced along the path from one of the end limits by a predetermined distance the sensor serving to generate an electrical detection signal which is fed to the control unit when the machine is detected in the vicinity of the sensor and is approaching the said one end limit to cause the control unit to provide the stop signal at a time to ensure the movement at the machine will cease at or near the said one end limit.

By using the existing overload protection means already incorporated in the chain drive the system can be constructed at low cost. Preferably the control unit incorporates a computer which is programmed to generate the stop signal to actuate the disengaging mechanism at a calculated time. Inter alia, the computer can evaluate the timing of the stop signal in dependence on the predetermined distance, the speed of movement of the machine and the response time of the disconnection mechanism. When the stop signal is received by the overload protection means the latter responds by disconnecting the drive, i.e. the motor and gearing, from a chain wheel driving the chain. The chain and chain wheel are thus protected from high inertial forces which can be dissipated as friction. Since the control system operates automatically there is no need for manual intervention and the machine can be allowed to creep right up to the stop means without the danger of damage occurring.

The system can be constructed in various ways. For example, a sensor, such as an optical sensor, may be disposed at each end region of the path of the machine and connected to its own control unit. The sensors can be mounted in a protected position in or on the guide defining the path. The control units are then connected to separate drive assemblies at the ends of the working but a signal from one of the control units can be used to disengage both drive assemblies. In another embodiment a single control unit receives signals from both sensors and generates the stop signal which controls both drive assemblies.

Preferably the system is designed so that the sensors only provide signals when the machine is moving in one direction or so that the control unit or units only respond to such signals. Thus as the machine approaches one end stop and passes one sensor near the end stop the drive is disengaged to halt the machine but when the machine is made to reverse its direction of movement and passes the same sensor again the drive is not disengaged.

Further sensors can be disposed along its path or guide at spaced intervals so that the control unit or units can evaluate the direction of movement of the machine and its speed from the successive signals emitted by the sensors.

In another embodiment intelligent sensors can be employed which use microprocessors to determine the direction of travel of the machine and its speed without the need for several successive signals to be provided.

The overload protection means itself can be one in which an electromagnetic valve is responsive to the stop signal generated by the control system and serves to open a fluid flow path to release a clutch hydraulically. The same function can also occur should the chain drive experience an abnormally high load.

The invention may be understood more readily, and various other aspects and features of the invention may become apparent, from consideration of the following description.

BRIEF DESCRIPTION OF DRAWING

An embodiment of the invention will now be described by way of example only with reference to the following description and the accompanying drawing which is a schematic representation of a control system constructed in accordance with the invention.

DESCRIPTION OF PREFERRED EMBODIMENT

In the accompanying drawing a mineral winning machine 1, such as a plough is movable along a guide 2. The guide 2 is for example disposed either at the mineral face side or the opposite goaf face side of a longwall scraper-chain conveyor (not shown) itself arranged along a longwall mine working and alongside a mineral face which is won with the machine 1. For convenience only one end region of the guide 2 is represented in the drawing. The machine 1 is propelled back and forth along the guide 2 to strip mineral from the mineral face and to drive the machine 1 a chain 3 is used. At one end, the chain 3 is fixed to the machine 1 as at 4 and the chain is entrained around a chain wheel 5 and extends along the length of the guide 2. At the other end region of the guide 2 the chain 3 is similarly entrained around another chain wheel (not shown) and the other end of the chain 3 can be likewise fixed to the machine 4. At least one of the chain wheels 5 and more preferably both chain wheels 5 are driven to move the chain 3 and hence the machine 1 along the working. As shown in the drawing, the chain wheel 5 is driven with drive means 6 composed of a motor 7, usually an electric motor and more particularly an asynchronous motor, which is coupled through a gearing assembly 8 to a drive shaft 9 carrying the chain wheel 5. The gearing assembly 8 is provided with an overload protection means which as is known operates automatically to disconnect the drive shaft 9 from the drive train in the event of overloading for example of the passage of the machine 1 is blocked. Overload protection means are known in various constructional forms and one suitable type is that shown in "Glückauf" 1990, pages 621 to 627 and FIG. 2, herein incorporated by reference. The overload protection means employed in the system constructed in accordance with the invention has an output line 10 which carries a signal indicative of the overload condition. The line 10 is connected as an input to an evaluation and control unit 11. The unit 11 has an output line 12 which is connected back to the gearing assembly 8. In the event of an overload condition and a generated signal inputted to the unit 11 on the line 10 the unit 11 responds by generating a signal on the line 12 which serves to actuate a mechanism to disconnect the drive shaft 9 from the gearing and the motor 7. The mechanism can employ an electromagnetic valve responsive to the signal on the line 12 to open to permit pressure fluid to operate a clutch which serves to disconnect the drive.

At both ends of the guide 2 there is a stop means 13 which defines the limit of movement of the machine 1 along the face. At a pre-determined distance x from each stop means 13 there is a sensor 14. The sensor 14 is mounted in a protected position in or on the guide 2 and provides an electrical signal on a line 15 when the machine 1 is detected by the sensor 14. The line 15 is connected as an input to the unit 11. The distance x is used to define a path over which retardation or deacceleration of the movement of the machine 1 takes place. Assuming the machine 1 is moving in the direction of arrow 16 towards the stop means 13 when the sensor 14 generates a signal to indicate the presence of the machine 1 at or near the sensor 14 the resulting signal on the line 15 is inputted to the unit 11. The unit 11 employs a computer which stores data equivalent to the distance x as well as the dynamic speed of movement or the maximum sheet of movement of the machine 1 and the response time needed to actuate the drive-disconnection mechanism. The computer can thus evaluate the time needed to bring the machine 1 to a halt and can generate at the appropriate time a stop signal on the line 12. A signal proportional to the rotational speed of the chain wheel 5 can be provided to the unit 11 to enable the computer to determine the dynamic speed of the machine 1. If the machine 1 is moving at a somewhat lower speed than the maximum the computer can generate the stop signal somewhat later than is the case when the machine 1 is moving at the maximum speed. Thus the existing overload protection means is employed to halt the machine 1 in an optimum manner so that whatever the speed of the machine 1 the stop signal provided by the unit 11 will be generated at an appropriate time to reliably disconnect the drive. Even with the inertia of the machine 1 and its drive the machine 1 will come to a standstill at or very close to the stop means 13 as is desired under various operational conditions.

It is envisaged that a control unit 11 as described would be provided at both ends of the working so that the machine 1 will be controlled in the manner described as it approaches either of the stop means 13. It is advisable to connect the units 11 by way of a line 17 to ensure that whenever one of the units 11 generates the stop signal on the line 12 the other unit 11 also generates the stop signal on the line 12 to ensure that both drives are disconnected.

The sensors 14 may be adapted to respond only when the machine 1 is moving towards the associated stop means 13 so that on the next run when the drive is reversed and the machine 1 moves away from the stop means 13 the sensor 14 does not respond to the presence of the machine 1. This function can also be accomplished by programming the computer to ignore a sensor signal unless the machine 1 is moving in one direction towards the associated stop means 13. The control system as described can be used with partially or fully automatic mineral winning operations or with installations in which the machine 1 is controlled manually.

We claim:

1. A control system for automatically halting the movement of a chain-driven mining machine moved back and forth along a path defined between end limits alongside a mineral face; said system comprising:

at least one drive means for driving the chain and the machine along said path, overload protection means with a mechanism for automatically disconnecting the drive means in the event of an overload, a control means which receives an electrical signal indicative of an overload and provides an electrical stop signal to actuate the mechanism and to disconnect the drive means, and a sensor spaced along the path from one of the end limits by a predetermined distance, the sensor serving to generate an electrical detection signal which is fed to the control means when the machine is detected in the vicinity of the sensor and is approaching the one end limit so as to cause the control means to provide the stop signal at a time to ensure the movement of the machine will cease at or near said one end limit.

2. A system according to claim 1, wherein the control means comprises a computer which evaluates the timing of the stop signal after the detection signal is provided by the sensor in accordance with:

(1) the predetermined distance, (2) the speed of movement of the machine, and (3) the response time of the disconnecting mechanism associated with the overload protection means.

3. A system according to claim 1, wherein the system is adapted to respond to the detection signal only when the machine is moving in one direction to approach said one end limit.

4. A system according to claim 1, wherein said system comprises two drive means, one dispose at each of both end limits, each of the drive means having its own overload protection means and a disconnection mechanism, and a sensor associated therewith so that the movement of the machine is automatically halted at each of the end limits.

5. A system according to claim 4, wherein said control means comprises a common control unit which receives detection signals from each of the sensors and provides stop signals to each of the disconnection mechanisms.

6. A system according to claim 4, wherein said control means comprises two control units, each receiving a detection signal from one of the sensors at each end limit, the control units being interconnected so that the stop signals generated from each of the control units are provided to the respective disconnection mechanisms.

7. A system according to claim 1, further comprising a plurality of sensors spaced at different pre-determined distances from said one end limit.

8. A system according to claim 1, wherein the drive means comprises a motor and a gearing assembly driving a chain wheel, and wherein the disconnection mechanism comprises an electromagnetic valve and fluid operated clutch.

9. A system according to claim 1, wherein a guide is used to define said path, and wherein stop means positioned at the ends of the guide define the end limits, the sensor being provided on or in the guide.

10. A system according to claim 8, wherein the motor is an electric motor.

* * * * *